US008701350B2

(12) United States Patent
Vulpitta

(10) Patent No.: US 8,701,350 B2
(45) Date of Patent: Apr. 22, 2014

(54) REMOVABLE WINDOW DRAFT BLOCKER

(75) Inventor: Brian A. Vulpitta, Avon Lake, OH (US)

(73) Assignee: Shurtech Brands, LLC, Avon, OH (US)

( * ) Notice: Subject to any disclaimer, the term of this patent is extended or adjusted under 35 U.S.C. 154(b) by 0 days.

(21) Appl. No.: 13/495,527

(22) Filed: Jun. 13, 2012

(65) Prior Publication Data

US 2013/0333294 A1 Dec. 19, 2013

(51) Int. Cl.
*E06B 1/70* (2006.01)

(52) U.S. Cl.
USPC ..... 49/470; 49/469; 49/475.1

(58) Field of Classification Search
USPC ..... 49/70, 467, 469, 470, 475.1, 482.1; 292/342, 343; 16/82; 160/40
See application file for complete search history.

(56) References Cited

U.S. PATENT DOCUMENTS

| | | | | |
|---|---|---|---|---|
| 6,405,488 | B1 | 6/2002 | Brown | |
| 6,560,932 | B2 | 5/2003 | Heroux | |
| 7,401,439 | B2 | 7/2008 | Heroux | |
| 7,891,136 | B1 * | 2/2011 | Heroux | 49/470 |
| 8,141,298 | B2 * | 3/2012 | Heroux | 49/470 |
| 8,161,685 | B2 * | 4/2012 | Salgado | 49/470 |
| 2011/0030281 | A1 * | 2/2011 | Vulpitta | 49/490.1 |
| 2011/0113696 | A1 * | 5/2011 | Gallagher | 49/493.1 |

FOREIGN PATENT DOCUMENTS

| | | |
|---|---|---|
| FR | 2787825 | 6/2000 |
| GB | 875480 | 8/1961 |

* cited by examiner

*Primary Examiner* — Katherine Mitchell
*Assistant Examiner* — Catherine A Kelly
(74) *Attorney, Agent, or Firm* — Fay Sharpe LLP

(57) ABSTRACT

A window draft blocker uses resilient elements held in spaced parallel relationship within a rectangular envelope and also has at least one impervious sleeve surrounding one of the resilient bodies protecting it from the elements.

10 Claims, 3 Drawing Sheets

REMOVABLE WINDOW DRAFT BLOCKER

FIELD OF THE APPLICATION

The present application relates to removable draft blockers and more particularly to a draft blocker adapted to engage the bottom of the window sash.

BACKGROUND OF THE DISCLOSURE

Homes are generally provided with several windows allowing sunshine into the home and allowing occupants to look outside the home. Double-hung sash windows are popular in the United States. Double-hung sash windows consist of two sashes contained in a rectangular frame. Often, at least the lower sash is movable in the vertical direction allowing one to open and close the window. Sashes usually consist of sash frame material, such as wood, surrounding several glass window panes. The bottom of the lower sash rests against a window sill. Window sills are often wood.

Wooden window frames and wooden sash frames and wooden window sills can shrink and swell with humidity changes and other weather changes. Window frames and window sills are also subject to wear, warpage, misalignment and the like. Thus, the place where the lower sash rests against the window sill is often not an air tight seal and drafts ensue. Such drafts can cause discomfort in the home and increase energy needs in heating and cooling the home.

The exterior of windows is often exposed to environmental elements including rain water, snow, sunlight, wind, and blown and splashed dirt.

Not all home occupants are home owners. Many people rent houses, apartments, condominiums and other structures as living space. Renters, and home owners in some situations, often prefer a removable appliance to address a draft through a window rather than repairing or replacing the window itself.

SUMMARY OF THE DISCLOSURE

In accordance with the present disclosure, a removable window draft blocker is provided having an elongate flexible envelope adapted to accommodate resilient bodies in spaced apart parallel relationship and at least one elongate semi-rigid elastic water impervious sleeve adapted to surround one of the resilient bodies contained within the envelope. The draft blocker is adapted to engage the bottom of the window sash to prevent or minimize drafts entering between the window sash and window sill.

Further in accordance with the disclosure, the window draft blocker has two sleeves telescoped one within the other allowing the length of the combined sleeves to be easily adjusted.

Yet further in accordance with the disclosure, the at least two elongate resilient bodies are cylindrical compressible foam bodies and the sleeves are semi-rigid elastic plastic cylinders with a longitudinal slit.

Yet further in accordance with the disclosure, the envelope portion of the draft blocker is rectangular in shape and constructed from a non-wicking fabric such as a nylon spandex blend.

It is the principle object of the present disclosure to provide a window draft blocker which is easily installed, easily removed, easily cleaned and adapted to remain clean even in the portion exposed to the outside elements.

It is another object of the present disclosure to provide a window draft blocker which is easily adjustable to accommodate windows of different widths.

It is another object of the present disclosure to provide a window draft blocker which is durable, attractive, and self-guiding in installation.

It is still another object of the present disclosure to provide a window draft blocker which fits snuggly against the bottom of a window without being crushed by the window sash.

These and other objects of the disclosure will become apparent in the following description of the exemplary embodiment taken together with the accompanying drawings.

BRIEF DESCRIPTION OF THE DRAWINGS

The disclosure may take physical form in certain parts and arrangements of parts, examples of which will be described in detail and which are illustrated in the accompany drawings which form a part hereof and wherein.

DETAILED DESCRIPTION

Figure 1:
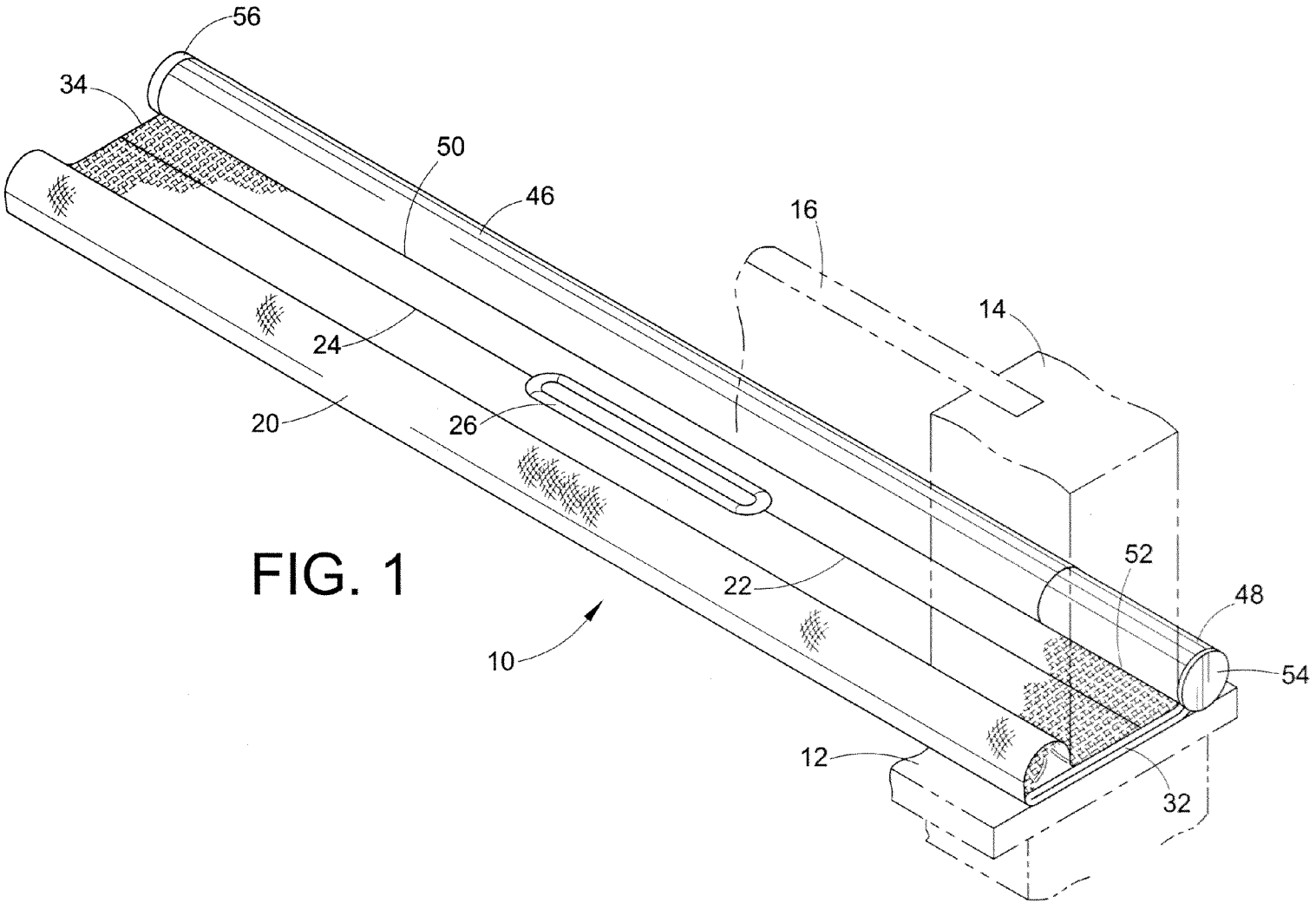
FIG. 1 is a perspective view of an embodiment of the disclosure installed between a lower window sash and a window sill.

With reference to FIG. 1, a window draft blocker 10 is shown between a window sill 12 and a window sash 14, the sill and sash shown partially cut away in phantom. The window sash 14 supports at least one glass pane 16.

An envelope 20 is generally rectangular in shape with two long edges and two short edges. The envelope 20 is fabricated from flexible sheet like material such as fabric. A rectangle of fabric is folded in half and the two ends which have been brought together are sewn together along most of their length but left disconnected at their center. This creates a first seam 22, a second seam 24, and a central opening 26 between the first seam 22 and the second seam 24. The central opening 26 is finished with overstitching in a manner similar to a button hole in a shirt or coat. The fabric is then realigned so that first and second seams and the central opening are at the center line of the top layer of the envelope with uninterrupted fabric forming the bottom layer. The two open ends of this intermediate are then sewn together forming a third seam 32 and a fourth seam 34. The envelope 20 is now complete. The envelope 20 is closed except for the finished central opening 26. The central opening 26 and the first seam 22 and second seam 24 are disposed in the portion of the envelope which will be located between the window sash 14 and the window sill 12 when the draft blocker 10 is in place and the window is closed. The portions of the envelope which remain visible to the user are seamless and more attractive.

Figure 3:
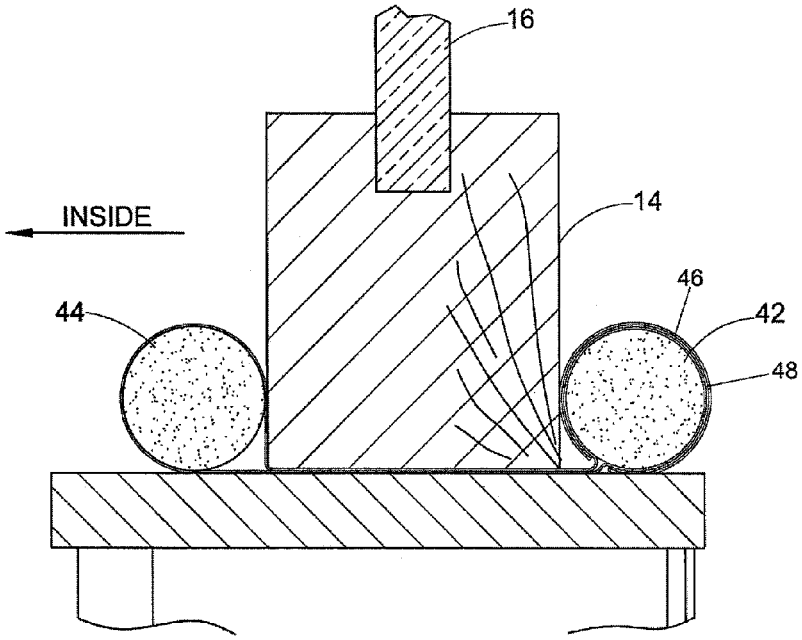
FIG. 3 is a cross section of the embodiment seen in FIGS. 1 and 2 taken along line 2-2 of FIG. 2; and, FIG. 4 is an enlarged view of a portion of the cross-section of FIG. 3 showing the embodiment in more detail.

Referring to FIG. 3, the envelope 20 surrounds a first elongate resilient body 42 and a second elongate resilient body 44. The elongate resilient bodies 42, 44 in this embodiment are resilient foam cylinders. Other materials such as non-woven fiber can be used. The elongate resilient bodies can be single elongate resilient bodies on each side or multiple elongate resilient bodies positioned coaxially on each side of the window sash 14.

Figure 4:
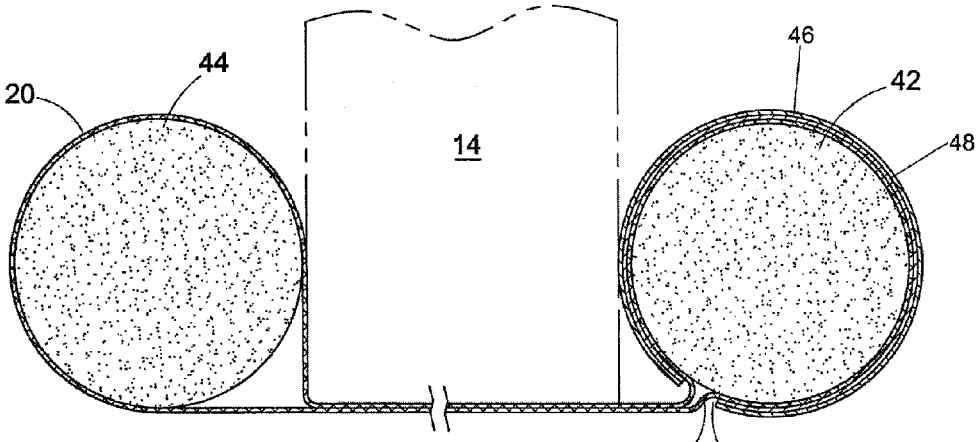

FIG. 3 shows a notation identifying the inside portion of the structure in which the window is located. That orientation is carried over into FIG. 4. Referring now to FIG. 4, and FIG. 1, a pair of elongate, elastic, semi-rigid water impervious sleeves 46, 48 surround the second elongate body 44 and the portion of the envelope 20 surrounding the first elongate body 42. Both sleeve 46, 48 are tubular with a circular cross-section and an axial slit 50, 52 along its entire length. The sleeves have a thin wall thickness, on the order of 0.3 mm and are semi-rigid and elastic. The sleeves are about an inch in diameter. The first sleeve 46 overlays the second sleeve 48 over a portion of its length with the two slits 50, 52 aligned. This allows the sleeves 46, 48 to be positioned over the elongate resilient body 42 with the envelope 20 passing through the slits 50, 52. The sleeves 46, 48 are sufficiently rigid to hold their shape but sufficiently elastic to be easily expanded in diameter for telescoping. They resemble the material used for plastic shower rod covers.

The preferred material for the envelope 20 is a textile fabric such as a polyester such as a terylene or a nylon spandex blend. Such fabrics are easily cleaned in a washing machine or by hand. Such fabrics are durable and have some elasticity. The envelope can stretch somewhat and, in the preferred embodiment, will be somewhat stretched and held tight against the bottom of a window sash in installation.

Figure 2:
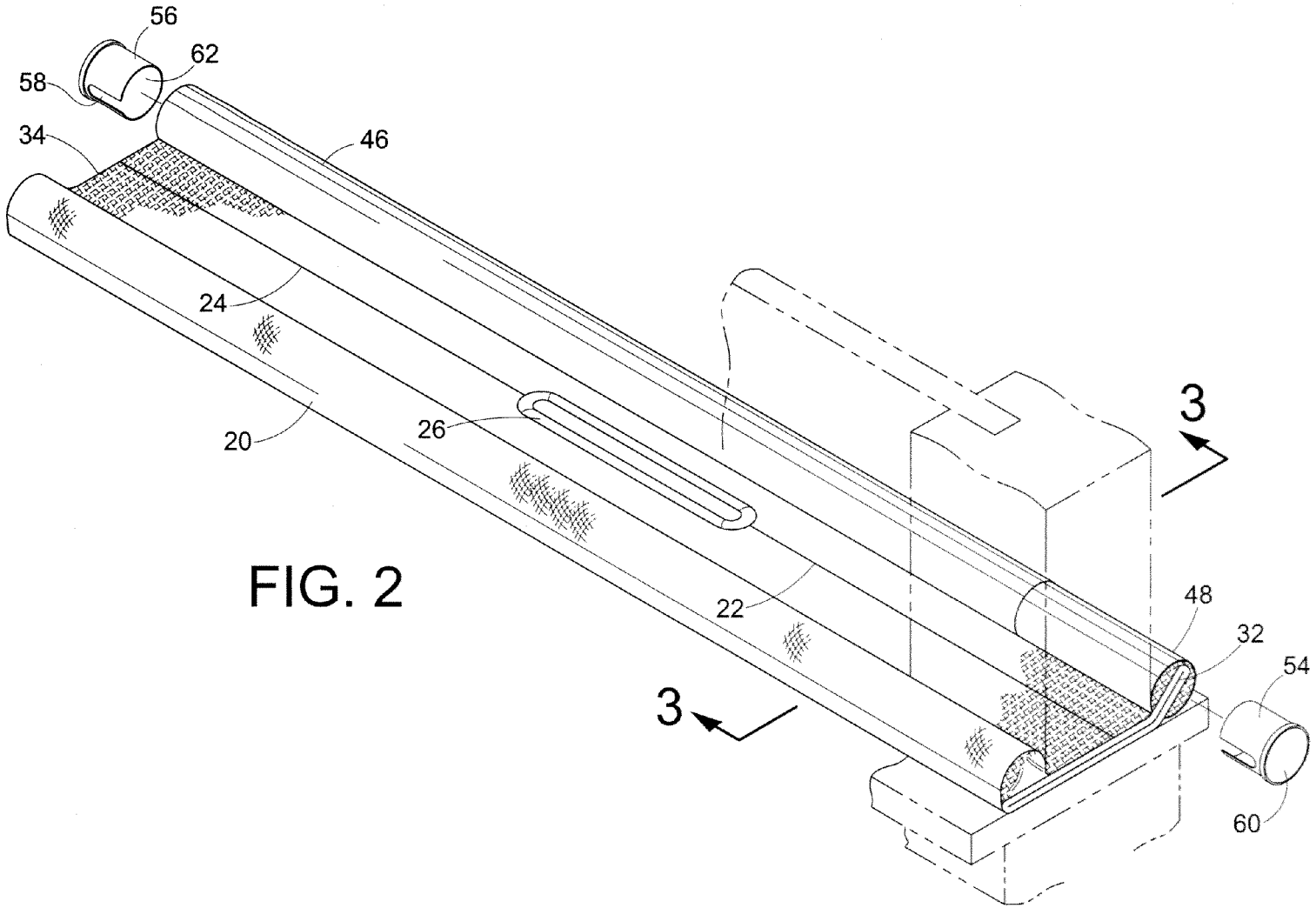
FIG. 2 is a view similar to FIG. 1 with the end caps removed.

Two cylindrical end caps 54, 56 are shown installed on the ends of the sleeves 46, 48. The end caps are shown in more detail in FIG. 2. The end caps are made from the same material or similar material as the sleeves 46, 48. The end caps have slit cylindrical sidewalls 58 one closed end 60 and one open end 62. The end caps 54, 56 are slid inside the ends of the sleeves 46, 48. The end caps 54, 56 may also be slid over the ends of the sleeves 46, 48.

The window draft blocker 10 is a consumer product in which two or more elongate resilient bodies, an envelope, two sleeves and two end caps are provided in a package. The consumer cuts the elongate resilient bodies to an appropriate length matching the width of the window with which the appliance is to be used. Two or more of the elongate resilient bodies are placed in the envelope 20 and aligned by manipulation with the hand into spaced apart parallel relationship. The two sleeves 46, 48 are slid onto the envelope and elongate resilient body 42 and adjusted to cover the entire length of one of the parallel elongate resilient bodies. End caps 54, 56 are applied over the ends of the sleeves 46, 48. The assembled window draft blocker is then placed on a sill under the sash of the window to be treated. The sash is brought down into contact with the window draft blocker 10. The user can hold the second elongate resilient body 44 in place on the inside of the window as the sash is lowered. The sash impinges upon the semi-rigid sleeves 46, 48 which have a slick exterior surface. The window sash 14 will push the sleeves 46, 48 outwardly as it descends resulting in proper alignment of the sleeves 46, 48 on the outside of the sash 14. Without the sleeves 46, 48, the sash might come down on the outside resilient body 42 crushing it, rather than having it positioned outside the window.

In this installed position, the envelope 20 is protected from the elements by the sleeves 46, 48 and end caps 54, 56. Because the sleeves and end caps are impervious, should they get dirty, they are simply wiped with a cloth or paper towel restoring a clean appearance. The envelope 20 is fabricated from a fabric which is non-wicking. Moisture will not be drawn into the interior space by wicking action of the envelope.

The appearance of the window draft blocker 10 from the inside of the house is simple and unobtrusive. The exposed surface is entirely the fabric of the envelope 20 with minimal seams on the ends of the envelope only. The fabric for the envelope 20 is selected in an appropriate color and pattern for use in the home. The appearance of the window draft blocker 10 from the exterior is also pleasing in that the appearance is that of the sleeves 46, 48 and end caps 54, 56 exclusively. This is a impervious plastic surface which is of appropriate color and easily kept clean.

Upon becoming soiled or at the end of a particular heating or cooling season, the window draft blocker 10 is easily removed by opening the window sash and picking the draft blocker 10 up. The sleeves 46, 48 and end caps 54, 56 are removed and cleaned. The elongate resilient bodies 42, 44 are removed and the envelope 20 washed. The clean draft blocker 10 can be stored and is ready for use in the next heating or cooling season.

The draft blocker is easily sized to fit various width windows. This is done by cutting the resilient bodies 42, 44 and putting them in the envelope 20. Because the envelope 20 is a flexible fabric with some elasticity, it can fit windows of various widths. Narrow windows can be accommodated by simply wrinkling the envelope. All other components are easily cut or telescoped to a desired length. All components are easily cleaned.

An exemplary embodiment has been described with reference to the preferred components and arrangements of components. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A removable adjustable window draft blocker adapted to engage the bottom of a window sash comprising:

at least two elongate resilient bodies;

an elongate flexible envelope having an opening large enough to admit the elongate resilient bodies, the envelope adapted to accommodate two resilient bodies in spaced apart parallel relationship;

at least one elongate, elastic, semi-rigid water impervious sleeve adapted to slide relative to the envelope and partially surround one of the resilient bodies contained within the envelope, the sleeve having an axial slit along its entire length such that a portion of the envelope passes through the slit and extends therefrom to be located between an associated window sash and associated window sill when the draft blocker is in place along the associated window sill and the associated window sash is closed.

2. The window draft blocker of claim 1 comprising at least two elongate, elastic, semi-rigid water impervious sleeves, each with a longitudinal slit, adapted to telescope, one within the other whereby the combined length of the two sleeves may be adjusted.

3. The window draft blocker of claim 1 wherein the envelope is a rectangular non-wicking fabric envelope.

4. The window draft blocker of claim 3 wherein the envelope is a nylon and spandex blend fabric.

5. The window draft blocker of claim 1 wherein the elongate resilient bodies are compressible foam bodies.

6. The window draft blocker of claim 5 wherein the elongate resilient bodies are cylindrical.

7. The window draft blocker of claim 1 wherein the at least one sleeve is a plastic sleeve with a wall thickness of about 0.3 millimeters.

8. The window draft blocker of claim 7 further comprising two split cylindrical plastic caps adapted to fit over the ends of the plastic sleeves.

9. The window draft blocker of claim 1 wherein the envelope opening is not in an end of the envelope.

10. A removable adjustable window draft blocker adapted to engage the bottom of a window sash comprising:

at least two elongate resilient bodies;

an elongate flexible envelope having an opening large enough to admit the elongate resilient bodies, the envelope adapted to accommodate two resilient bodies in spaced apart parallel relationship;

at least two elongate, elastic, semi-rigid water impervious sleeves adapted to partially surround one of the resilient bodies contained within the envelope, the sleeves, each with an axial slit along its entire length such that a portion of the envelope passes through the slits wherein the sleeves telescope, one within the other whereby the combined length of the two sleeves may be adjusted.

* * * * *